US008020983B2

(12) United States Patent
Nishimori

(10) Patent No.: US 8,020,983 B2
(45) Date of Patent: Sep. 20, 2011

(54) IMAGE FORMING APPARATUS

(75) Inventor: Takehiro Nishimori, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 870 days.

(21) Appl. No.: 12/026,657

(22) Filed: Feb. 6, 2008

(65) Prior Publication Data

US 2008/0218571 A1 Sep. 11, 2008

(30) Foreign Application Priority Data

Mar. 7, 2007 (JP) ..... 2007-056789

(51) Int. Cl.
*B41J 2/19* (2006.01)

(52) U.S. Cl. ..... 347/92; 347/7

(58) Field of Classification Search ..... 347/92
See application file for complete search history.

(56) References Cited

U.S. PATENT DOCUMENTS

| | | | | |
|---|---|---|---|---|
| 5,657,058 | A * | 8/1997 | Mochizuki et al. | 347/7 |
| 5,790,157 | A * | 8/1998 | Higuma et al. | 347/85 |
| 5,903,294 | A * | 5/1999 | Abe et al. | 347/87 |
| 6,505,923 | B1 * | 1/2003 | Yamamoto et al. | 347/85 |
| 6,520,630 | B1 * | 2/2003 | Oda et al. | 347/85 |
| 2002/0135645 | A1 * | 9/2002 | Barinaga et al. | 347/85 |
| 2003/0007048 | A1 * | 1/2003 | Otsuka et al. | 347/89 |
| 2003/0160846 | A1 * | 8/2003 | Yoshida et al. | 347/85 |
| 2003/0227520 | A1 * | 12/2003 | Yamanaka et al. | 347/85 |
| 2004/0061748 | A1 * | 4/2004 | Kuwabara et al. | 347/85 |
| 2004/0090501 | A1 * | 5/2004 | Yoshida et al. | 347/85 |
| 2005/0151800 | A1 * | 7/2005 | Kono et al. | 347/85 |
| 2006/0152558 | A1 * | 7/2006 | Hoisington | 347/84 |
| 2007/0222829 | A1 * | 9/2007 | Stathem | 347/85 |
| 2008/0055378 | A1 * | 3/2008 | Drury et al. | 347/92 |

FOREIGN PATENT DOCUMENTS

| | | |
|---|---|---|
| JP | 9-240019 | 9/1997 |
| JP | 11-320901 | 11/1999 |
| JP | 3181138 | 4/2001 |
| JP | 2002-166570 | 6/2002 |
| JP | 2002-370374 | 12/2002 |
| JP | 2003-1846 | 1/2003 |
| JP | 2006-68904 | 3/2006 |
| JP | 2006-327097 | 12/2006 |

* cited by examiner

*Primary Examiner* — Charlie Peng
*Assistant Examiner* — Peter Radkowski
(74) *Attorney, Agent, or Firm* — Cooper & Dunham LLP

(57) ABSTRACT

An image forming apparatus is disclosed that includes an exhaust unit that discharges air accommodated in a second liquid accommodating unit; a liquid transfer unit that transfers liquid from a first liquid accommodating unit to the second liquid accommodating unit via a liquid supply path and retransfers liquid from the second liquid accommodating unit to the first liquid accommodating unit via the liquid supply path; and a control unit that activates the exhaust unit and the liquid transfer unit according to an air bubble detection result of an air bubble detection unit, controls the liquid transfer unit to transfer a predetermined amount of liquid from the first liquid accommodating unit to the second liquid accommodating unit, and controls the liquid transfer unit to retransfer liquid from the second liquid accommodating unit to the first liquid accommodating unit according to a liquid level detection result of a liquid level detection unit.

11 Claims, 8 Drawing Sheets

IMAGE FORMING APPARATUS

BACKGROUND

1. Technical Field

This disclosure relates to an image forming apparatus that discharges liquid droplets.

2. Description of the Related Art

An image forming apparatus such as a printer, a facsimile machine, a copier, or a multifunction machine may use a liquid discharge apparatus including a recording head that is made up of liquid discharge heads that discharge droplets of recording liquid for applying recording liquid (also referred to as 'ink' hereinafter) on a recording medium (also referred to as 'paper', 'paper sheet', 'transfer material', or 'recording paper' hereinafter) while conveying the recording medium to form (record/print) an image, for example.

It is noted that in the following descriptions, the term 'image forming apparatus' may be used to refer to any apparatus that is configured to discharge liquid on a recording medium of any suitable material such as paper, textile, fiber, fabric, leather, metal, plastic, glass, wood, or ceramic to form an image thereon. Also, the term 'image forming' is used to refer to forming (applying) any type of image on a recording medium including an image having meaning such as characters and graphics as well as an image having no meaning such as a pattern. Also, the recording liquid may be any suitable liquid that may be used to form an image on a recording medium and is not limited to ink. Also, the term 'liquid discharge apparatus' is used to refer to any apparatus that discharges liquid from a liquid discharge head.

It is noted that an image forming apparatus that uses such a liquid discharge apparatus for forming an image may be in various configurations. For example, the image forming apparatus may have a head tank (also referred to as sub tank or buffer tank) arranged on a carriage as a second liquid accommodating container for accommodating a small amount of recording liquid (ink) to be supplied to the recording head and a large-capacity main cartridge (main tank) arranged at the apparatus main frame side as a first liquid accommodating container so that ink may be supplied to the head tank from the main cartridge arranged at the apparatus main frame side. As another example, the image forming apparatus may have an ink cartridge as a liquid accommodating container that can be exchanged along with a recording head.

In an image forming apparatus that uses a conventional head tank, a flexible resin tube is often used as a supply path for supplying ink from the main tank to the head tank in consideration of wiring within the apparatus, assembling facility, and safety, for example. Also, when negative pressure generating means is arranged within the head tank, an elastic film is often used. However, in such a case, air from the outside may gradually permeate through the film over time to thereby cause air to eventually penetrate into the head tank. Further, air residing in the main tank, air that enters the supply path of the main tank upon its attachment/detachment, or air that is dissolved in the ink may be carried via the ink supply path to eventually end up being accumulated in the head tank.

In this respect, Japanese Laid-Open Patent Publication No. 2006-068904 discloses arranging an outward ink tube for sending ink from the main tank towards the liquid discharge head and a homeward ink tube that extends from the liquid discharge head to the main tank so that air bubbles accumulated in the outward ink tube may be discharged from an air release unit arranged within a sub tank that is disposed between the liquid discharge head and the homeward ink tube.

Also, Japanese Patent No. 3181138 discloses connecting a sub tank to the atmosphere, utilizing the hydraulic head difference between the sub tank and the main tank to redirect ink within the sub tank back to the main tank, and then re-supplying a predetermined amount of ink to the sub tank to remove air bubbles.

Also, Japanese Laid-Open Patent Publication No. 11-320901 discloses opening a valve arranged at a sub tank when a suction head connected to a tubing pump arranged at the image forming apparatus comes into contact with the valve, and discharging air within the sub tank by driving the tubing pump while the valve is opened in the above-described manner.

However, the configuration disclosed in Japanese Laid-Open Patent Publication No. 2006-068904 requires an outward ink tube and a homeward ink tube for each color so that wiring and assembly of the apparatus may become complicated and costs may be raised.

Also, the configuration disclosed in Japanese Patent No. 3181138 that uses the hydraulic head difference to cause ink within the sub tank to flow back to the main tank may require a relatively long processing time. Further, with this configuration, problems may occur in a case where the main tank is exchanged to a new main tank and is left without being used for a long time. That is, since the new main tank is full, ink within the sub tank may not be able to flow back to the main tank so that air bubbles penetrating into the supply path cannot be removed.

Also, the configuration disclosed in Japanese Laid-Open Patent Publication No. 11-320901 that arranges the suction head for discharging air within the sub tank to come into contact with or be detached from the valve arranged within the sub tank, the apparatus structure may be complicated and the air bubble discharging effect may be degraded when the seal of the contacting portions is weak.

SUMMARY

In an aspect of this disclosure, there is provides an approach for efficient and accurate removal of air bubbles entering a supply path while keeping the amount of liquid discharged to a small amount and enabling stable image forming operations in an image forming apparatus.

In another aspect, an image forming apparatus is provided that includes:

a recording head that discharges liquid droplets;

a first liquid accommodating unit that accommodates liquid to be supplied to the recording head;

a second liquid accommodating unit that temporarily accommodates liquid received from the first liquid accommodating unit via a liquid supply path and supplies the received liquid to the recording head;

an air bubble detection unit that detects air bubbles that have penetrated into the liquid supply path;

a liquid level detection unit that detects a liquid level within the second liquid accommodating unit;

an exhaust unit that discharges air accommodated within the second liquid accommodating unit;

a liquid transfer unit that is configured to transfer liquid from the first liquid accommodating unit to the second liquid accommodating unit via the liquid supply path and retransfer liquid from the second liquid accommodating unit to the first liquid accommodating unit via the liquid supply path; and a control unit that is configured to activate the exhaust unit and the liquid transfer unit according to an air bubble detection result of the air bubble detection unit, control the liquid transfer unit to transfer a predetermined amount of liquid from the first liquid accommodating unit to the second liquid accommodating unit, and control the liquid transfer unit to retransfer liquid from the second liquid accommodating unit to the first liquid accommodating unit according to a liquid level detection result of the liquid level detection unit.

In one preferred embodiment, the liquid transfer unit may be a pressurizing/depressurizing pump that is arranged at the liquid supply path. In another preferred embodiment, the liquid transfer unit may be a pressurizing/depressurizing pump that is detachably attached to the first liquid accommodating unit.

In another preferred embodiment, the air bubble detection unit may include at least one metal element arranged within the liquid supply path and at least one metal element arranged at the second liquid accommodating unit. In another preferred embodiment, the liquid level detection unit may include at least one pair of metal elements arranged at the second liquid accommodating unit.

In another preferred embodiment, the predetermined amount of liquid to be transferred to the second liquid accommodating unit by the liquid transfer unit may be equal to a total internal volume of the liquid supply path. In another preferred embodiment, provided that a volume of liquid that is always stored in the second liquid accommodating unit is denoted as V1, and a total internal volume of the liquid supply path is denoted as V2, a liquid accommodating capacity of the second liquid accommodating unit, denoted as V, may be arranged to satisfy a relationship of $V \geqq V1+V2$.

In another preferred embodiment, provided that a force generated by the hydraulic head difference between the liquid discharge face of the recording head and the liquid level within the second liquid accommodating unit at a time of transferring liquid from the first liquid accommodating unit to the second liquid accommodating unit is denoted as Ph0, a meniscus maintaining force of the liquid discharge face of the recording head is denoted as P0, and the pressure for transferring liquid from the first liquid accommodating unit to the second liquid accommodating unit by the liquid transfer unit is denoted as P1, operations of the liquid transfer unit may be controlled to satisfy the relationship $P0>P1+Ph0$.

In another preferred embodiment, provided that a force generated by the hydraulic head difference between the liquid discharge face of the recording head and the liquid level within the second liquid accommodating unit at a time of retransferring liquid from the second liquid accommodating unit to the first liquid accommodating unit is denoted as Ph0, a meniscus maintaining force of the liquid discharge face of the recording head is denoted as P0, and the pressure for retransferring liquid from the second liquid accommodating unit to the first liquid accommodating unit by the liquid transfer unit is denoted as P2, operations of the liquid transfer unit may be controlled to satisfy the relationship $P0>P2-Ph0$.

The aforementioned and other aspects, features and advantages will become more apparent from the following detailed description when read in conjunction with the accompanying drawings.

DETAILED DESCRIPTION OF THE PREFERRED EMBODIMENTS

In the following, preferred embodiments of the present invention are described with reference to the accompanying drawings.

Figure 1:
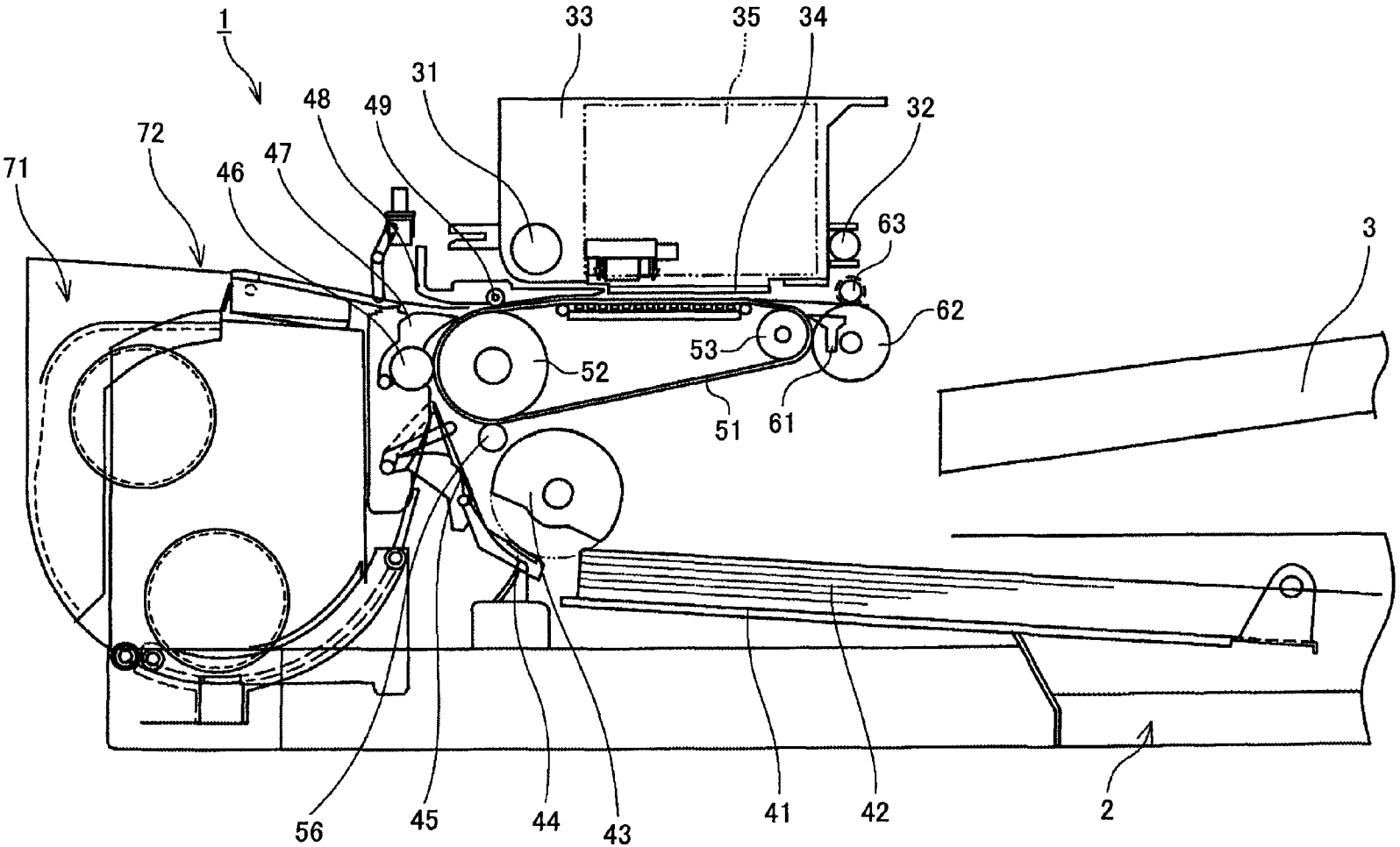
FIG. 1 is a side view of an image forming apparatus according to an embodiment of the present invention.
Figure 2:
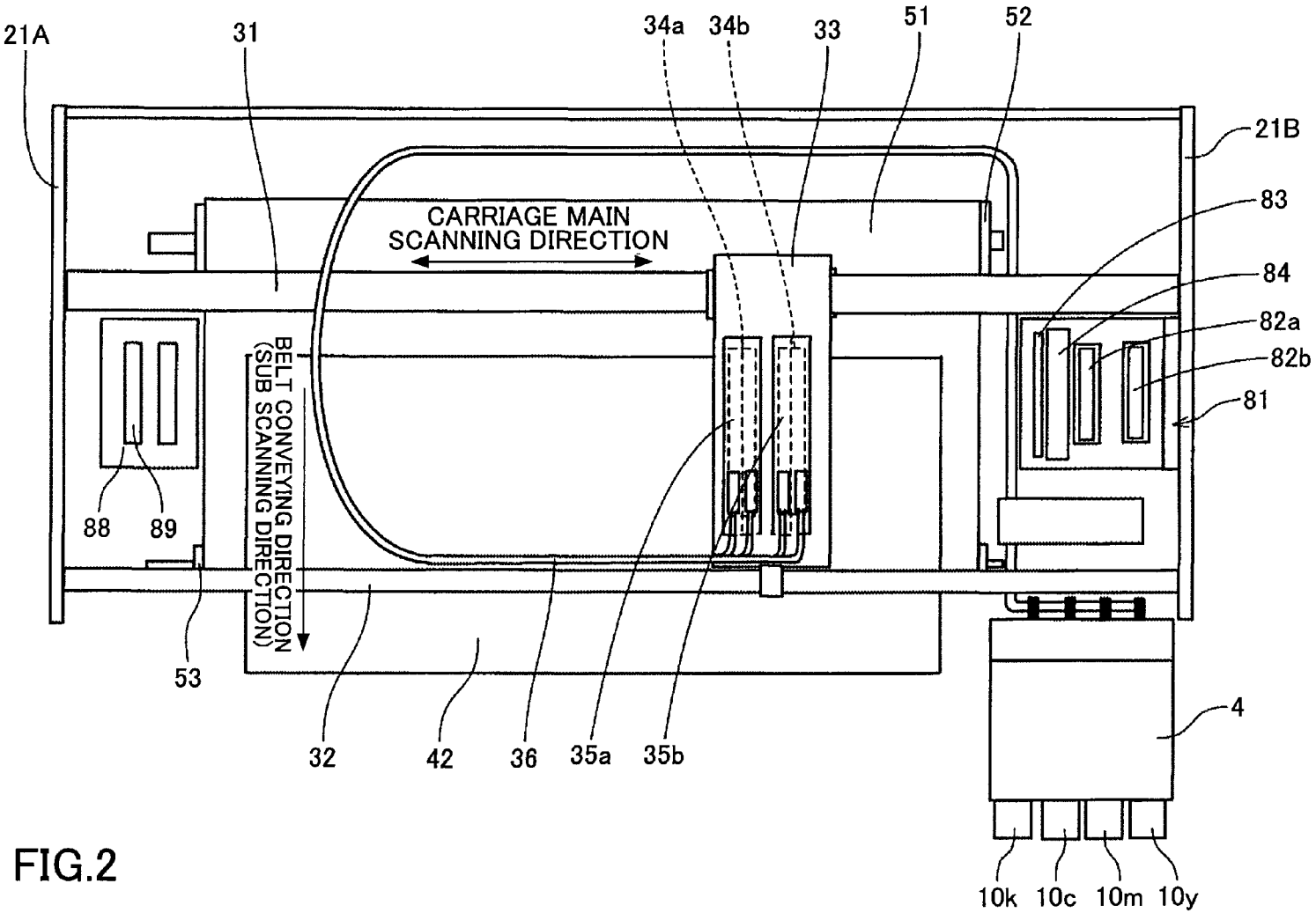
FIG. 2 is a plan view of a part of the image forming apparatus shown in FIG. 1.

First, an image forming apparatus according to an embodiment of the present invention is described with reference to FIGS. 1 and 2. FIG. 1 is a side view of the image forming apparatus according to the present embodiment, and FIG. 2 is a plan view of a relevant part of the image forming apparatus according to the present embodiment.

The image forming apparatus according to the present embodiment is a serial type image forming apparatus that includes an apparatus main frame 1 having left and right side boards 21A and 21B across which guide members including main and sub guide rods 31 and 32 are arranged. The guide rods 31 and 32 hold a carriage 33 so that the carriage 33 can slide in the main scanning direction. A main scanning motor (not shown) drives the carriage 33 in the directions of the arrow shown in FIG. 2 (carriage main scanning directions) via a timing belt.

The carriage 33 has recording heads 34*a* and 34*b* (simply referred to as 'recording head 34' when distinctions are not made between the two) that include liquid discharge heads for discharging ink droplets of the colors yellow (Y), cyan (C), magenta (M), and black (K). The recording head 34 has plural nozzles forming nozzle rows aligned in the sub scanning direction, which is perpendicular to the main scanning direction, and is attached to the carriage 33 so that an ink droplet discharge direction is directed downward.

The recording heads 34 each include two nozzle rows. Specifically, one of the nozzle rows of the recording head 34*a* discharges black (K) liquid droplets, and the other nozzle row of the recording head 34*a* discharges cyan (C) liquid droplets. Also, one of the nozzle rows of the recording head 34*b* discharges magenta (M) liquid droplets and the other nozzle row of the recording head 34*b* discharges yellow (Y) liquid droplets.

The carriage 33 has sub tanks 35*a* and 35*b* (simply referred to as 'sub tank 35' when distinctions are not made between the two) as buffer tanks corresponding to second liquid accommodating units for supplying inks of the above colors to the nozzle rows of the recording heads 34. The sub tanks 35 are arranged to have inks of the above colors supplied thereto via corresponding supply tubes 36 from ink cartridges 10*y*, 10*m*, 10*c*, and 10*k* corresponding to first liquid accommodating units that are detachably loaded in a cartridge loading unit 4.

Also, the illustrated image forming apparatus includes a sheet feeding portion for feeding sheets of paper 42 stacked on a sheet stacking part 41 of a sheet feed tray 2. The sheet feeding portion includes a sheet feeding roller 43 for conveying the sheets of paper 42 one at a time from the sheet stacking part 41 and a separating pad 44 facing the paper feeding roller 43 and having a friction coefficient sufficient for separating sheets of paper 42 from the sheet stacking part 41. The separating pad 44 is configured to urge the sheets in the direction toward the sheet feeding roller 43.

The paper sheet 42 conveyed from the sheet feeding portion is conveyed to an area below the recording head 34. In order to convey the paper sheet 42 to the area below the recording head 34, the illustrated image forming apparatus includes a guide member 45 that guides the paper sheet 42, a counter roller 46, a conveying guide member 47, a press member 48 having an edge pressurizing roller 49, and a conveyor belt 51 as a conveying unit that attracts the paper sheet 42 with electrostatic force and conveys the paper sheet 42 in a position facing the recording head 34.

In the illustrated embodiment, the conveyor belt 51 is an endless belt stretched between a conveyor roller 52 and a tension roller 53 that is configured to move around in a belt conveying direction (sub scanning direction). Also, a charging roller 56 for charging the surface of the conveyor belt 51 is provided. The charging roller 26 is arranged to come into contact with the surface layer of the conveyor belt 51 and rotate in accordance with the rotation of the conveyor belt 51. The conveyor belt 51 is arranged to move around in the belt conveying direction as is shown in FIG. 2 in accordance with the rotation of the conveyor roller 52 that is driven by a sub scanning motor (not shown).

The illustrated image forming apparatus also includes a sheet discharging portion for discharging the sheet of paper 42 having an image recorded thereon by the recording head 34. The sheet discharging portion includes a separating claw 61 for separating the paper sheet 42 from the conveyor belt 51, a sheet discharging roller 62, a spur 63, and a sheet discharge tray 3 arranged below the sheet discharging roller 62.

Also, a double-side sheet feeding unit 71 may be detachably arranged at a rear portion of the image forming apparatus main frame 1. By rotating the conveyor belt 51 in the reverse direction, the paper sheet 42 is delivered to the double-side sheet feeding unit 71 at which the paper sheet 42 is flipped upside down. Then, the flipped paper sheet 42 is conveyed and re-fed between the counter roller 46 and the conveyor belt 51. Also, a manual feed tray 72 is arranged on the upper face of the double-side sheet feeding unit 71.

Furthermore, as shown in FIG. 2, a maintenance/recovery mechanism 81 for maintaining/restoring the operating status of the nozzles of the recording heads 34 may be provided at a non-printing area toward one side of the main scanning direction of the carriage 33. The maintenance/recovery mechanism 81 includes plural caps 82*a* and 82*b* (simply referred to as 'cap 82' when distinctions are not made between the two) for covering the surface of the nozzles of the recording heads 34, a wiper blade 83 for wiping off residual ink from the surface of the nozzles, and a receptacle 84 for receiving recording liquid that is discharged in idle discharge operations unrelated to recording for disposing undesired ink that has become viscous, for example.

Also, as is shown in FIG. 2, a receptacle 88 as a liquid collecting container is provided at the other side of the non-printing area with respect to the main scanning direction of the carriage 33. The receptacle 88 is for receiving liquid droplets discharged in idle discharge operations unrelated to recording for discharging liquid droplets of recording liquid that has become overly viscous during recording operations, for example. The receptacle 88 includes openings 89 extending along the nozzle row directions of the nozzles of the recording heads 34.

In the image forming apparatus with the above-described configuration, sheets of paper 42 are separated and conveyed sheet by sheet from the sheet feeding portion, then the separated and conveyed paper sheet 42 is guided to the part between the conveyor belt 51 and the counter roller 46 in an upright manner by the guide 45, and then the orientation of the conveyed paper is changed approximately 90 degrees by guiding the edge of the paper with the conveyor guide 47 and pressing the paper sheet 42 against the conveyor belt 51 with the edge pressurizing roller 49.

In this conveying operation, alternating voltages alternating between positive and negative outputs are applied to the charging roller 56 so that the conveyor belt 51 is alternately charged with negative and positive voltages at intervals of a predetermined width along the belt conveying direction (sub scanning direction) in accordance with the alternate charging pattern. When the paper sheet 42 is conveyed onto the alternately charged conveyor belt 51, the paper sheet 42 is attracted to the conveyor belt 51 by electrostatic force. Thus, the paper sheet 42 is conveyed in the sub-scanning direction by the rotation of the conveyor belt 51.

Herein, the recording heads 34 are driven according to image signals while the carriage 33 is moved. In this way, the recording heads 34 may discharge ink droplets to record one line image on the paper sheet 42 that is held still after which the paper sheet 42 is conveyed by a predetermined amount to have the recording heads 34 record a next line image. The recording operations of the recording heads 34 may be completed when a signal is received indicative of the completion of the recording operation or indicative of the rear end of the paper sheet 42 reaching the edge of the recording area. After the completion of the recording operation, the paper sheet 42 is discharged to the discharge tray 3.

In the following, an ink supply system of the above-described image forming apparatus according to a first embodiment of the present invention is described with reference to FIG. 3.

Figure 3:
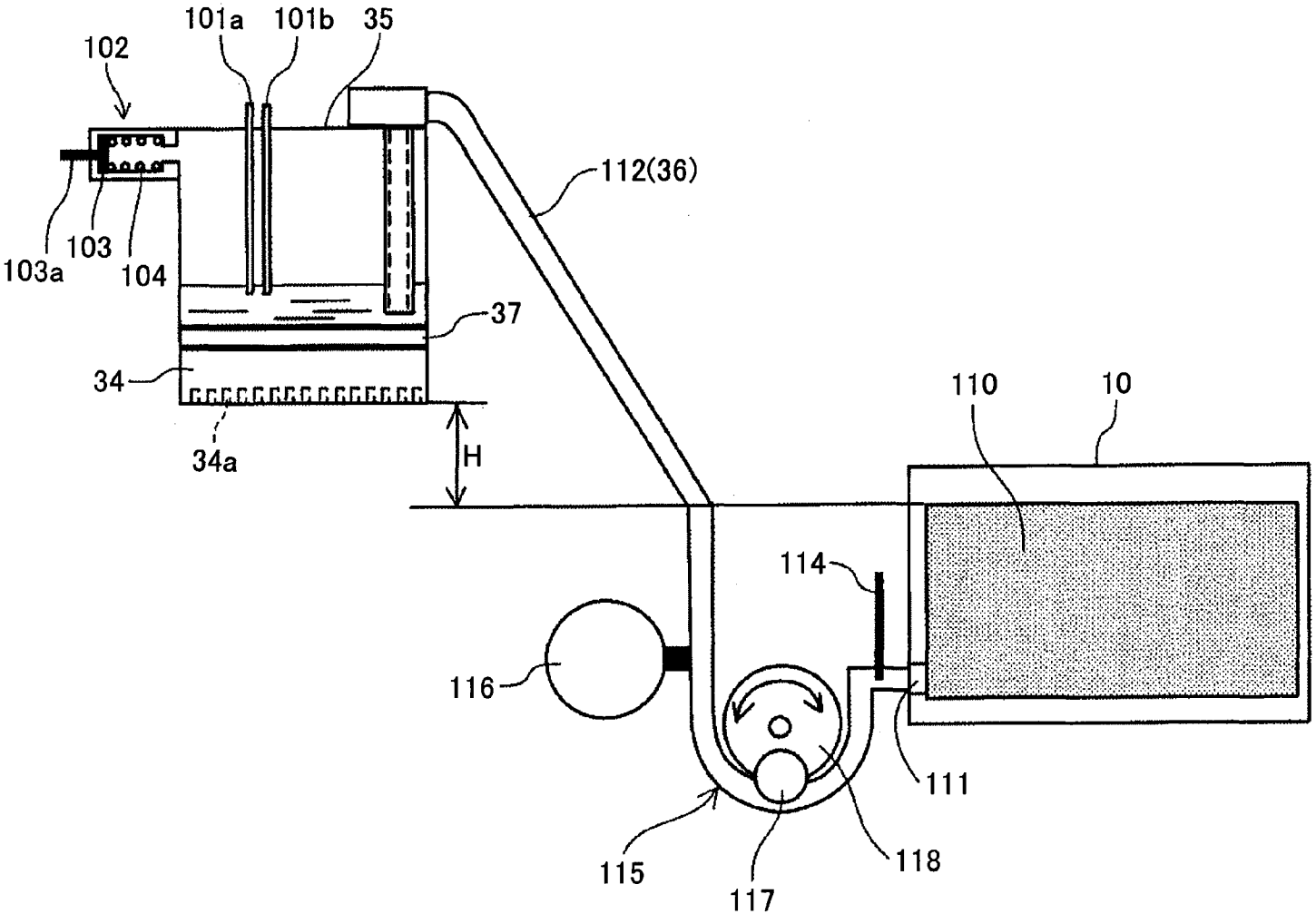
FIG. 3 is a diagram illustrating an ink supply system according to a first embodiment of the present invention.

FIG. 3 is a diagram showing a configuration of an ink supply system according to the present embodiment.

The recording head 34 and the sub tank 35 as the second liquid accommodating unit are integrally attached via a filter 37 and are mounted in the carriage 33 as is described above. The sub tank 35 has a pair of detection electrodes 101*a* and 101*b* installed therein that correspond to a pair of metal elements for detecting whether ink resides in the sub tank 35. The sub tank 35 also has an air release mechanism 102 arranged therein as an exhaust unit for releasing air accumulated within the sub tank 35. The pair of detection electrodes 101*a* and 101*b* may respectively be connected to positive and negative terminals, for example. The electric resistance between the detection electrodes 101*a* and 101*b* may change depending on whether the detection electrodes 101*a* and 101*b* are in contact with ink, and in this way, a determination may be made as to whether ink resides in the sub tank 35.

The air release mechanism 102 includes an elastic gasket part 103 that is fabricated through two color injection molding, for example, and a spring 104 that pushes the gasket part 103 so that the inner wall of the sub tank 35 may be sealed by the gasket part 103 and air may be blocked from entering the interior of the sub tank 35. The air release mechanism 102 may be connected to the atmosphere by having a pin member 103*a* of the gasket part 103 pushed from the outside by an air release drive unit (not shown) that is arranged at the apparatus main frame side.

The main tank 10 as the first liquid accommodating unit has a deformable ink bag 110 accommodated therein. The ink bag 110 may be deformed by external pressure and is configured to be connected to an ink supply path (liquid supply path) 112 via a connection part 111 when the main tank 10 is loaded in the apparatus main frame 1. The main tank 10 is positioned to secure a predetermined hydraulic head difference H with respect to the nozzles 34*a* of the recording head 34 so that a negative pressure may be generated with respect to the nozzles 34*a* of the recording head 34 by the hydraulic head difference.

Also, an air bubble detection electrode 114 made of one metal element is connected to the ink supply path 112 at an area close to the connection part 111. The air bubble detection electrode 114 may be connected to either a positive terminal or a negative terminal. When the air bubble detection electrode 114 is connected to a positive terminal, it may determine the presence of air bubbles based on the electric resistance between the air bubble detection electrode 114 and the electrode 101*b* (−) arranged within the sub tank 35. When the air bubble detection electrode 114 is connected to a negative terminal, it may determine the presence of air bubbles based on the electric resistance between the air bubble detection electrode 114 and the electrode 101*a* (+) arranged within the sub tank 35.

Also, a pump 115 as a liquid transfer unit that is capable of pressurizing and depressurizing the ink supply path 112 and a pressure sensor 116 for detecting the pressure within the ink supply path 112 are arranged at an intermediate section of the ink supply path 112.

The pump 115 is made up of an elastic deformable member (i.e., ink supply tube 36) that forms the ink supply path 112, a pressing member 117 that applies pressure to the elastic deformable ink supply tube 36, and a rotating member 118 that rotates the pressing member 117. The pressing member is configured to squeeze the ink supply tube 36 forming the ink supply path 112 while it is rotating so as to move the ink accommodated in the ink supply path 112. The pump 115 may be capable of transferring ink from the main tank 10 to the sub tank 35 via the ink supply path 112 and retransferring ink from the sub tank 35 to the main tank 10 via the ink supply path 112 depending on the rotating direction of the rotating member 118.

In the following, a control unit for controlling the above-described ink supply system is described with reference to FIG. 4.

Figure 4:
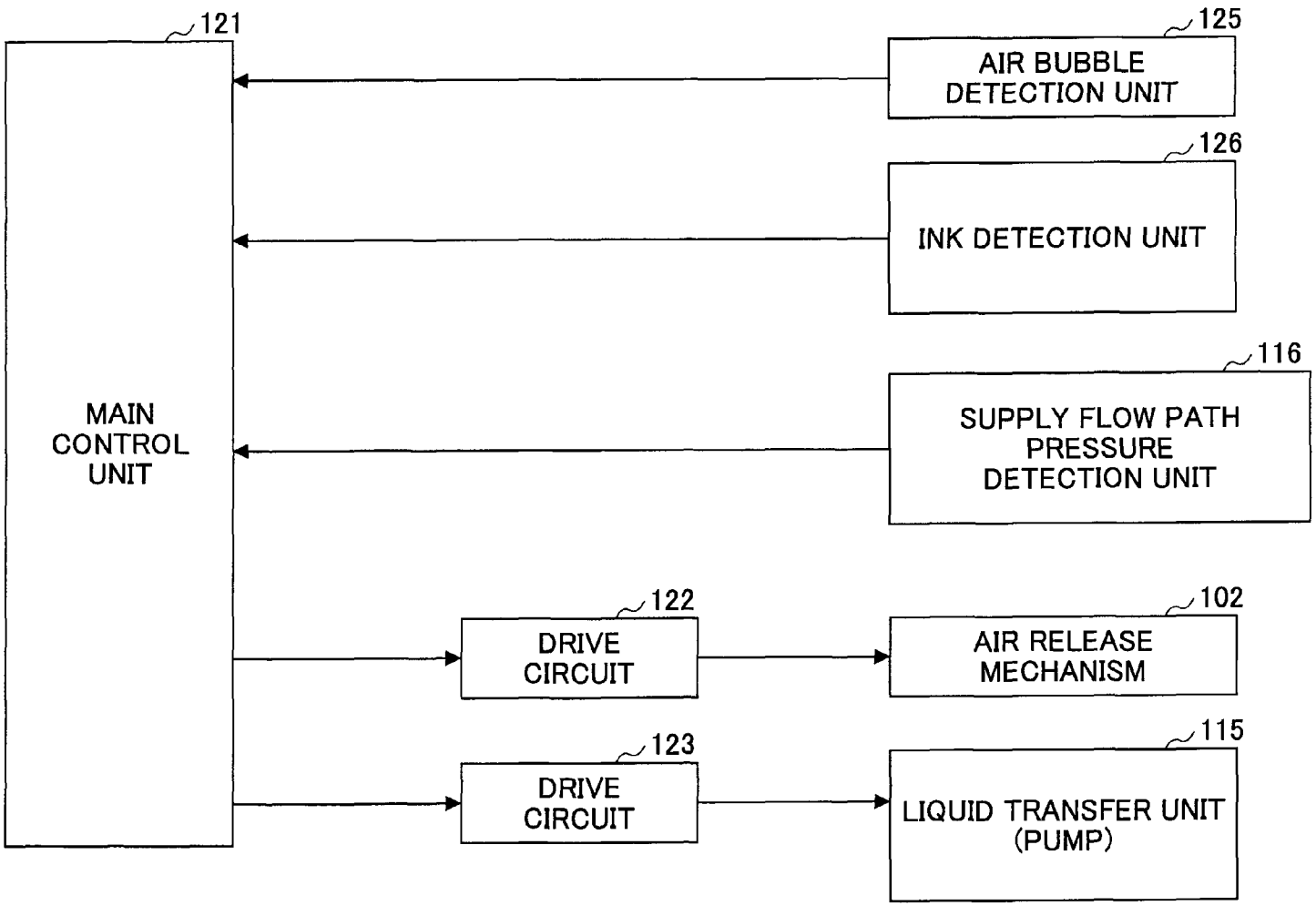
FIG. 4 is a block diagram illustrating components related to air bubble discharge control.

A main control unit 121 as is illustrated in FIG. 4 may be configured to control overall operations of the image forming apparatus including operations of the ink supply system. The control unit 121 may include a CPU, a ROM, a RAM, an I/O, and a rewritable non-volatile memory, for example. The control unit 121 is configured to drive and control operations of a drive source (e.g., electromagnetic solenoid; not shown) for pressing the pin member 103*a* of the air release mechanism 102 of the sub tank 35 via a drive circuit 122 so that the interior of the sub tank 35 may be opened and connected to the external atmosphere. Also, the control unit 121 is configured to drive and control operations of a drive source for rotating the rotating member 118 of the pump 115 via a drive circuit 123 to rotate the pressing member 117 so that ink within the ink supply path 112 may be moved.

In order to perform such drive control operations, the main control unit 121 receives detection signal inputs from an air bubble detection unit 125 that is realized by the air bubble detection electrode 114 arranged at the ink supply path 112 and the detection electrode 101*a* or 101*b*, an ink detection unit (liquid level detection unit) 126 that is realized by the pair of detection electrodes 101*a* and 101*b* arranged at the sub tank 35, and a supply path pressure detection unit 116 that detects the pressure within the ink supply path 112.

In the following, air bubble removal control operations are described with reference to FIGS. 5-8.

Figure 5:
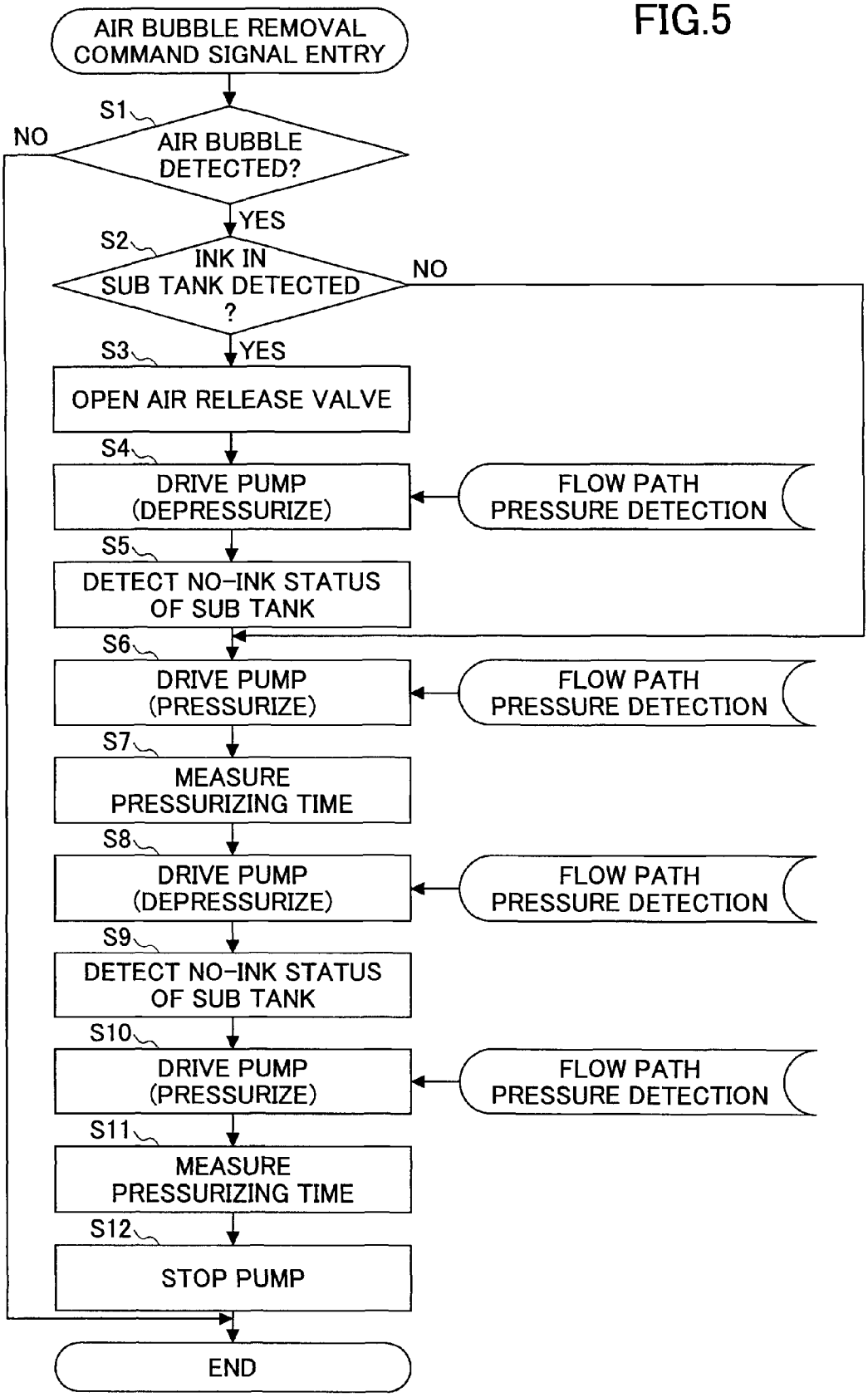
FIG. 5 is a flowchart illustrating air bubble discharge control operations.
Figure 6:
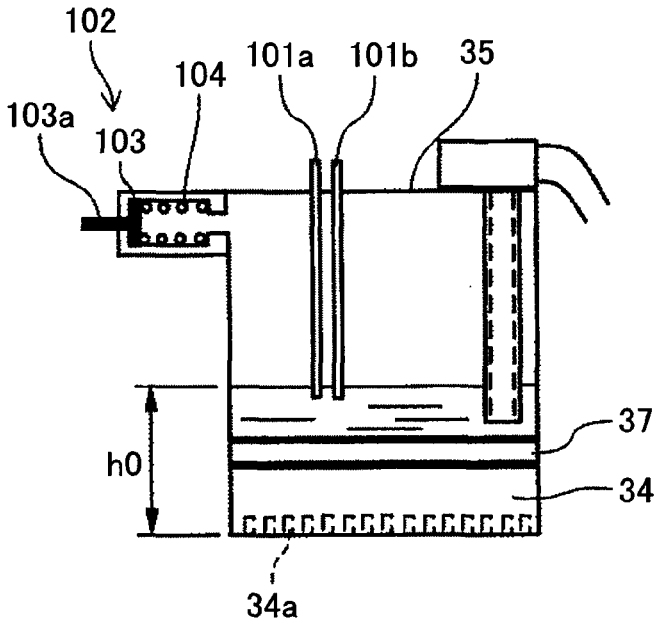
FIG. 6 is a diagram illustrating the air bubble discharge control operations at a certain stage.

FIG. 5 is a flowchart illustrating process steps of air bubble removal control process operations. As is shown in this drawing, the process is started when an air bubble removal command signal is entered in response to which a determination is made as to whether air bubbles exist within the ink supply path 112 based on a detection signal from the air bubble detection unit 125 (step S1).

In this case, if it is determined that air bubbles exist within the ink supply path 112 (step S1, YES), a determination is made as to whether ink exists within the sub tank 35 based on a detection signal from the ink detection unit 126 (step S2). If it is determined that ink exists within the sub tank 35 (step S2, YES), a drive source (actuator) of the air release mechanism 102 is driven to open the sub tank 35 to the external atmosphere (see FIG. 6).

Figure 7:
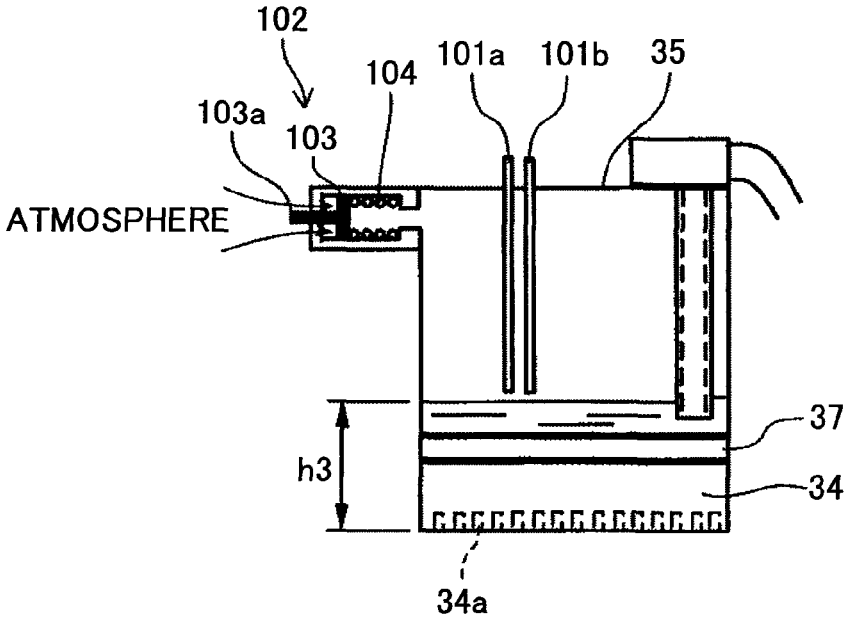
FIG. 7 is a diagram illustrating the air bubble discharge control operations at another stage.

Then, pressure P2 within the ink supply path 112 is detected based on a detection signal from the supply path pressure detection unit 116, and the pump 115 as the liquid transfer unit is driven to reduce the pressure within the ink supply path 112 (step S4) so that ink may be retransferred from the sub tank 35 to the main tank 10 until a no-ink status detection signal indicating that there is no ink in the sub tank 35 is input from the ink detection unit 126 (step S5) (see FIG. 7).

In this case, provided that the force generated by the hydraulic head difference h3 between the liquid level of the ink within the sub tank 35 and the ink discharge face of the recording head 34 at this point is denoted as Ph0, the meniscus maintaining force of the ink discharge face of the recording head 34 is denoted as P0, and the pressure for retransferring the ink to the main tank 10 using the liquid transfer unit (pump) 115 is denoted as P2, the liquid transfer unit (pump) 115 is driven and controlled to satisfy the condition: P0>P2−Ph0.

By controlling drive operations of the liquid transfer unit 115 in the above-described manner, a predetermined amount of ink may be retransferred to the main tank 10 from the sub tank 35 without introducing air into the sub tank 35 from the ink discharging surface of the recording head 34, and even when the ink capacity within the sub tank 35 is not known, the ink capacity may be reset to a specific capacity. By resetting the ink capacity within the sub tank 35 to a specific capacity, ink may be prevented from overflowing out of the air release mechanism 102 even when ink is replenished through pressurization as is described in detail below.

Figure 8:
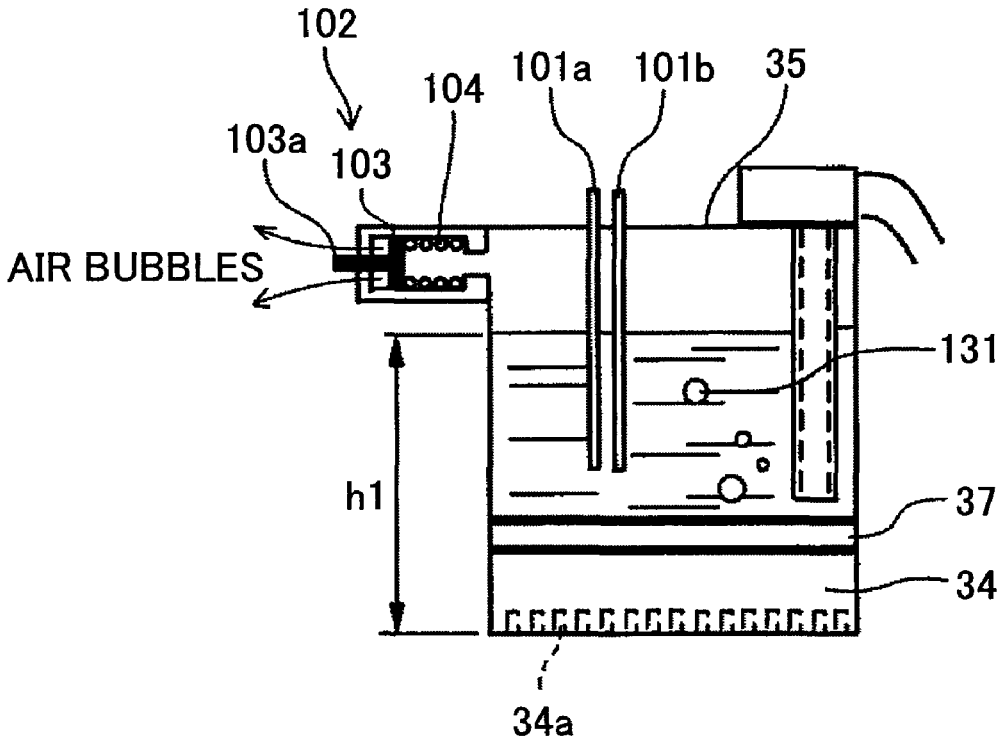
FIG. 8 is a diagram illustrating the air bubble discharge control operations at another stage.

Then, the pressure P1 within the ink supply path 112 is detected based on the detection signal from the supply path pressure detection unit 116, the liquid transfer unit 115 is driven to apply pressure onto the ink supply path 112 (step S6), and the drive time (pressurizing time) of the liquid transfer unit 115 is measured and controlled (step S7) so that a predetermined amount of ink corresponding to the total internal volume (capacity) of the ink supply path 112 may be transferred from the main tank 10 to the sub tank 35 (see FIG. 8). By arranging the predetermined amount of ink to be supplied to the sub tank 35 by the liquid transfer unit 115 to equal the total internal volume of the ink supply path 112, air bubbles that have entered the ink supply path 112 may be reliably transferred to the sub tank 35 corresponding to the second liquid accommodating unit so that the air bubbles within the ink supply path 112 may be properly removed.

In this case, provided that the volume of liquid that is always stored in the sub tank 35 is denoted as V1, the total internal volume of the ink supply path 112 is denoted as V2, and the volume of liquid that may be accommodated by the sub tank 35 is denoted as V, the ink supply system according to the present embodiment is designed to satisfy the condition V≧V1+V2. In this way, ink may be prevented from overflowing out of the air release mechanism 102 arranged at the sub tank 35 even when an amount of ink corresponding to the total internal volume of the ink supply path 112 is supplied from the main tank 10 to the sub tank 35.

Also, provided that the force generated by the hydraulic head difference h1 between the liquid level of the ink within the sub tank 35 and the ink discharge face of the recording head 34 at this point is denoted as Ph0, the meniscus maintaining force of the ink discharge face of the recording head 34 is denoted as P0, and the pressure for transferring ink from the main tank 10 to the sub tank 35 using the liquid transfer unit (pump) 115 is denoted as P1, the liquid transfer unit (pump) 115 is driven and controlled to satisfy the condition: P0>P1+Ph0. By controlling operations of the liquid transfer unit 115 in this manner, ink may be prevented from dripping from the ink discharge surface of the recording head 34, and air bubbles that have penetrated into the ink supply path 112 may be reliably transferred to the sub tank 35.

In turn, air bubbles 131 that have been transferred to the sub tank 35 along with ink may be directed upward within the sub tank owing to its buoyancy to eventually be discharged into the external atmosphere via the air release mechanism 102 (see FIG. 8).

Then, the liquid transfer unit 115 is driven and controlled to satisfy the condition P0>P2−Ph0 (step S8) so that ink may be retransferred from the sub tank 35 to the main tank 10 until a no-ink status detection signal indicating that there is no ink in the sub tank 35 is input from the ink detection unit 126 (step S9).

At this point, ink within the ink supply path 112 is replaced by ink containing no air bubbles.

Then, the liquid transfer unit 115 is driven and controlled to satisfy the condition P0>P1+Ph0 once again (step S10) and the rotating time (pressurizing time) of the liquid transfer unit 115 is measured and controlled (step S11) so that a predetermined amount of ink is supplied from the main tank 10 to the sub tank 35. Then, the liquid transfer unit (pump) 115 is stopped (step S12) to thereby end the ink supply control process.

By performing air bubble removal control operations in the above-described manner, the ink supply path 112 extending from the main tank 10 to the sub tank 35 may be filled with ink so that ink may be continually and stably supplied to the recording head 34, and in turn, faulty ink discharge operations due to shortage of ink supply may be prevented so that stable and accurate printing may be enabled.

As can be appreciated from the above descriptions, by providing a liquid transfer unit that is capable of transferring liquid from a first liquid accommodating unit to a second liquid accommodating unit via a liquid supply path as well as retransferring liquid from the second liquid accommodating unit back to the first liquid accommodating unit via the liquid supply path, activating an exhaust unit and the liquid transfer unit according to detection results of an air bubble detection unit, controlling the liquid transfer unit to transfer a predetermined amount of liquid from the first liquid accommodating unit to the second liquid accommodating unit, and then controlling the liquid transfer unit to retransfer liquid from the second liquid accommodating unit to the first liquid accommodating unit according to detection results of a liquid level detection unit, air bubbles penetrating into the liquid supply path may be properly detected and the air bubbles may be reliably discharged out of the exhaust unit arranged at the second liquid accommodating unit without having to discharge liquid so that printing defects due to a shortage of ink supply may be prevented and stable image formation operations may be performed.

Also, by using a pressurizing/depressurizing pump as the liquid transfer unit and arranging the pressurizing/depressurizing pump at the liquid supply path, liquid may be transferred and retransferred within a relatively short period of time and the amount of liquid transferred may be controlled by the pump drive time. Accordingly, the process time required for air bubble discharge control may be reduced to thereby realize efficiency. Also, since the liquid supply path may have a relatively simple configuration, greater flexibility may be secured with respect to wiring in the apparatus, and assembly of the apparatus may be improved as well.

Figure 9:
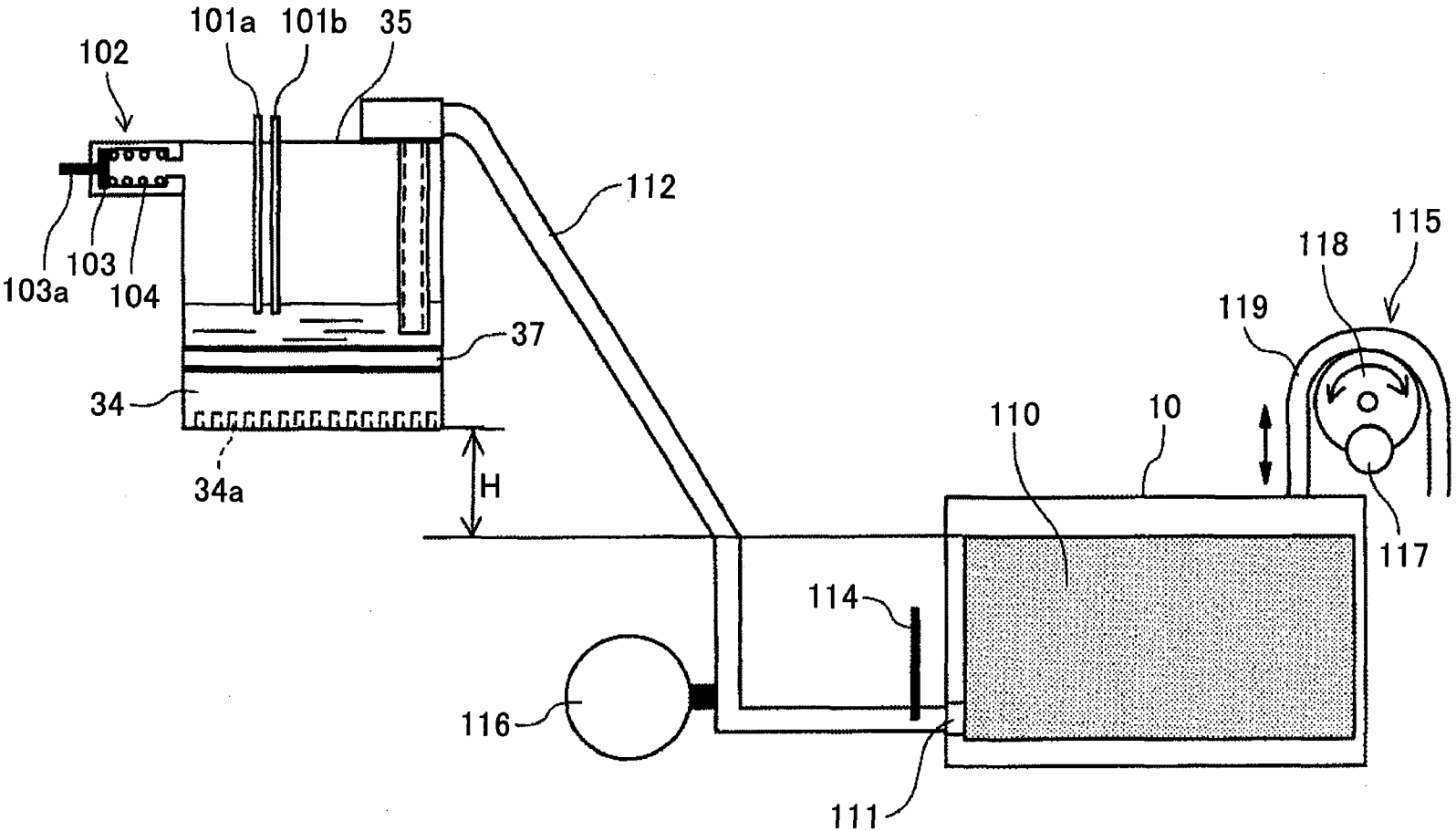
FIG. 9 is a diagram illustrating an ink supply system according to a second embodiment of the present invention.

In the following, an ink supply system according to a second embodiment of the present invention is described with reference to FIG. 9. It is noted that components shown in FIG. 9 that are substantially identical to the components shown in the previous drawings are given the same reference numerals and their descriptions are omitted.

According to the second embodiment, the liquid transfer unit 115 is detachably connected to the main tank 10 and is configured to convey air into the main tank 10 so that the ink bag 110 may be pressurized and ink may be transferred from the ink bag 110 to the ink supply path 112. Also, in the present embodiment, the liquid transfer unit 115 is configured to extract air from the main tank 10 so that the ink bag 110 may expand and ink may be transferred from the ink supply path 112 back to the ink bag 110.

With such a configuration, the ink supply path 112 does not necessarily have to be made of an elastic deformable member that deforms upon being pressed by the pressing member 117. Accordingly, barrier properties and durability of the ink supply path 112 may be improved, for example.

It is noted that air bubble removal control operations similar to those performed at the ink supply system according to the first embodiment as described above may be performed to remove air bubbles penetrating into the ink supply path 112 of ink supply system according to the present embodiment.

Also, it is noted that an image forming apparatus according to an embodiment of the present invention is not limited to an image forming apparatus only having printing functions and may also be a multi-function image forming machine having plural functions including printing, facsimile, and copying functions, for example. Further, liquid used in an image forming apparatus according to an embodiment of the present invention is not limited to ink.

The present invention is not limited to the specifically disclosed embodiments, and variations and modifications may be made without departing from the scope of the present invention.

The present application is based on and claims the benefit of the earlier filing date of Japanese Patent Application No. 2007-056789 filed Mar. 7, 2007, the entire contents of which are hereby incorporated herein by reference.

What is claimed is:

1. An image forming apparatus comprising:

a recording head including one or more nozzles to discharge liquid droplets;

a main tank that accommodates liquid to be supplied to the recording head;

a sub tank that temporarily accommodates liquid received from the main tank via a liquid supply path and supplies the received liquid to the recording head;

a filter integrally attaching the sub tank and the recording head;

an air bubble detection unit that detects air bubbles that have penetrated into the liquid supply path;

a liquid level detection unit that detects a liquid level within the sub tank, the liquid level detection unit including detection electrodes disposed within the sub tank for detecting whether liquid is contacting tips of the detection electrodes in the sub tank;

an exhaust unit that discharges air accommodated within the sub tank, the exhaust unit being configured to release air accumulated within the sub tank to outside atmosphere;

a liquid transfer unit including a rotary pump that rotates in one of two opposite directions to transfer liquid from the main tank to the sub tank via the liquid supply path and that rotates in the other of the two opposite directions to retransfer liquid from the sub tank to the main tank via the liquid supply path; and a control unit that is configured to activate the exhaust unit and the liquid transfer unit according to an air bubble detection result of the air bubble detection unit, control the liquid transfer unit to transfer a predetermined amount of liquid from the main tank to the sub tank via the liquid supply path and retransfer liquid from the sub tank to the main tank until the detection electrodes of the liquid level detection unit detect that the liquid is not contacting the tips of the detection electrodes, while controlling the exhaust unit to release air within the sub tank to the outside atmosphere, and control the liquid transfer unit to retransfer liquid from the sub tank to the main tank according to a liquid level detection result of the liquid level detection unit.

2. The image forming apparatus as claimed in claim 1, wherein the rotary pump is arranged at the liquid supply path.

3. The image forming apparatus as claimed in claim 1, wherein the liquid transfer unit is a pressurizing/depressurizing pump that is detachably attached to the main tank.

4. The image forming apparatus as claimed in claim 1, wherein the air bubble detection unit comprises at least one metal element arranged within the liquid supply path and at least one metal element arranged at the sub tank.

5. The image forming apparatus as claimed in claim 1, wherein the liquid level detection unit comprises at least one pair of metal elements arranged at the sub tank.

6. The image forming apparatus as claimed in claim 1, wherein the predetermined amount of liquid to be transferred to the sub tank by the liquid transfer unit is equal to a total internal volume of the liquid supply path.

7. The image forming apparatus as claimed in claim 1, wherein provided that a volume of liquid that is always stored in the sub tank is denoted as V1, and a total internal volume of the liquid supply path is denoted as V2, a liquid accommodating capacity of the sub tank, denoted as V, is arranged to satisfy a relationship of $V \geqq V1+V2$.

8. The image forming apparatus as claimed in claim 1, wherein a pressure generated by a hydraulic head difference between a liquid discharge face of the recording head and the liquid level within the sub tank at a time of transferring liquid from the main tank to the sub tank via the liquid supply path and retransfer liquid from the sub tank to the main tank is denoted as Ph0, a meniscus maintaining pressure of the liquid discharge face of the recording head is denoted as P0, a pressure for transferring liquid from the main tank to the sub tank via the liquid supply path and retransfer liquid from the sub tank to the main tank by the liquid transfer unit is denoted as P1, and the control unit controls operations of the liquid transfer unit to satisfy a relationship of $P0>P1+Ph0$, and wherein the main tank is positioned so as to have the hydraulic head difference H relative to the recording head, to generate a negative pressure due to the hydraulic head difference at the nozzles of the recording head.

9. The image forming apparatus as claimed in claim 1, wherein a pressure generated by a hydraulic head difference H between a liquid discharge face of the recording head and the liquid level within the sub tank at a time of retransferring liquid from the sub tank to the main tank is denoted as Ph0, a meniscus maintaining pressure of the liquid discharge face of the recording head is denoted as P0, a pressure for retransferring liquid from the sub tank to the main tank by the liquid transfer unit is denoted as P2, and the control unit controls operations of the liquid transfer unit to satisfy a relationship of $P0>P2-Ph0$, and wherein the main tank is positioned so as to have the hydraulic head difference H relative to the recording head, to generate a negative pressure due to the hydraulic head difference at the nozzles of the recording head.

10. The image forming apparatus as claimed in claim 1, wherein the control unit, in a case that the air bubble detection unit detects that the air bubbles exist within the liquid supply path and the liquid level detection unit detects that liquid exists within the sub tank, controls the exhaust unit and the rotary pump to perform an air bubble removal process comprising:

(a) operating the exhaust unit to release the air accumulated within the sub tank;

(b) driving the rotary pump to reduce pressure within the liquid supply path and retransfer liquid from the sub tank to the main tank, until the liquid level detection unit indicates that there is no liquid remaining within the sub tank;

(c) driving the rotary pump to apply pressure onto the liquid supply path, after the liquid level detection unit indicates that there is no liquid remaining within the sub tank in (b), to transfer a predetermined amount of liquid, corresponding to a total internal volume of the liquid supply path, from the main tank to the sub tank;

(d) driving the rotary pump again to reduce pressure within the liquid supply path, after the predetermined amount of liquid has been transferred from the main tank to the sub tank in (c), to retransfer liquid from the sub tank to the main tank, until the liquid level detection unit indicates that there is no liquid remaining within the sub tank; and (e) driving the rotary pump again, after the liquid level detection unit indicates that there is no liquid remaining within the sub tank in (d), to transfer the predetermined amount of liquid from the main tank to the sub tank.

11. The image forming apparatus as claimed in claim 1, wherein in a case that the detection electrodes of the liquid level detection unit detect no liquid contacting the tips of the detection electrodes, the control unit determines that no ink resides in the sub tank.

* * * * *